US007584777B2

(12) United States Patent
Hoberman et al.

(10) Patent No.: US 7,584,777 B2
(45) Date of Patent: Sep. 8, 2009

(54) PANEL ASSEMBLIES FOR VARIABLE SHADING AND VENTILATION

(75) Inventors: Charles Hoberman, 472 Greenwich St., New York, NY (US) 10013; Matthew Davis, Newton, PA (US)

(73) Assignee: Charles Hoberman, New York, NY (US)

( * ) Notice: Subject to any disclaimer, the term of this patent is extended or adjusted under 35 U.S.C. 154(b) by 0 days.

(21) Appl. No.: 11/692,979

(22) Filed: Mar. 29, 2007

(65) Prior Publication Data

US 2007/0235150 A1 Oct. 11, 2007

Related U.S. Application Data

(60) Provisional application No. 60/789,248, filed on Apr. 5, 2006.

(51) Int. Cl.
*E06B 9/00* (2006.01)

(52) U.S. Cl. ..... 160/218; 160/353; 160/161; 160/223

(58) Field of Classification Search ..... 160/40, 160/62, 202, 223, 136, 138, 139, 151, 161, 160/162, 165, 218, 130, 180, 219, 352, 353, 160/222; 52/64, 71, 70, 204.5, 786.11
See application file for complete search history.

(56) References Cited

U.S. PATENT DOCUMENTS

| | | | | | |
|---|---|---|---|---|---|
| 216,035 | A * | 6/1879 | Goodwin | 160/136 |
| 275,557 | A * | 4/1883 | Williams | 160/136 |
| 465,889 | A * | 12/1891 | Riester | 49/38 |
| 756,781 | A * | 4/1904 | Duffy | 160/139 |
| 1,122,441 | A * | 12/1914 | Tobias | 160/136 |
| 1,492,315 | A * | 4/1924 | Walker | 105/377.09 |
| 2,322,590 | A * | 6/1943 | Pickering et al. | 454/215 |
| 2,346,111 | A * | 4/1944 | MacKenzie | 256/67 |
| 2,522,158 | A * | 9/1950 | Bauers et al. | 40/601 |
| 2,955,651 | A * | 10/1960 | Replogle | 160/40 |
| 3,444,919 | A * | 5/1969 | Karoll | 160/184 |
| 4,020,889 | A * | 5/1977 | Karoll | 160/120 |
| 4,033,073 | A * | 7/1977 | Bogan | 49/38 |
| 4,290,244 | A | 9/1981 | Zeigler | |
| 4,942,700 | A | 7/1990 | Hoberman | |
| 4,981,732 | A | 1/1991 | Hoberman | |
| 5,016,390 | A * | 5/1991 | Johnson | 49/38 |
| 5,024,031 | A | 6/1991 | Hoberman | |
| 5,155,936 | A * | 10/1992 | Johnson | 49/38 |
| 5,234,727 | A | 8/1993 | Hoberman | |
| 5,274,980 | A | 1/1994 | Zeigler | |
| 5,651,228 | A | 7/1997 | Zeigler | |
| 6,082,056 | A | 7/2000 | Hoberman | |
| 6,190,231 | B1 | 2/2001 | Hoberman | |
| 6,219,974 | B1 | 4/2001 | Hoberman | |
| 6,352,097 | B1 * | 3/2002 | Kern et al. | 160/197 |

(Continued)

*Primary Examiner*—Blair M. Johnson
*Assistant Examiner*—Jaime F Cardenas-Garcia
(74) *Attorney, Agent, or Firm*—Gottlieb, Rackman & Reisman

(57) ABSTRACT

A variable panel assembly is herein disclosed which is comprised of a plurality of panels and a plurality of links where by rotating one or more links, the assembly shifts between a largely uncovered configuration to a covered configuration, where in the first configuration the panel profiles are essentially aligned, and in the second configuration the panel profiles are offset relative to one another. Further disclosed herein are methods to control the movement of the assembly, both manual and motorized.

15 Claims, 12 Drawing Sheets

U.S. PATENT DOCUMENTS 6,419,002 B1 * 7/2002 Wang ..... 160/222
6,463,705 B1 10/2002 Davis et al.
6,598,351 B2 * 7/2003 Hallberg ..... 52/9
6,739,098 B2 5/2004 Hoberman
6,834,465 B2 12/2004 Hoberman
6,963,708 B2 * 11/2005 Sekovski et al. ..... 399/171
2002/0083675 A1 7/2002 Hoberman
2002/0112413 A1 8/2002 Hoberman
2003/0140573 A1 * 7/2003 Marcinkowski et al. ..... 52/79.5
2004/0134157 A1 7/2004 Hoberman
2005/0097832 A1 5/2005 Hoberman
2007/0266648 A1 * 11/2007 Hoberman ..... 52/80.1

* cited by examiner

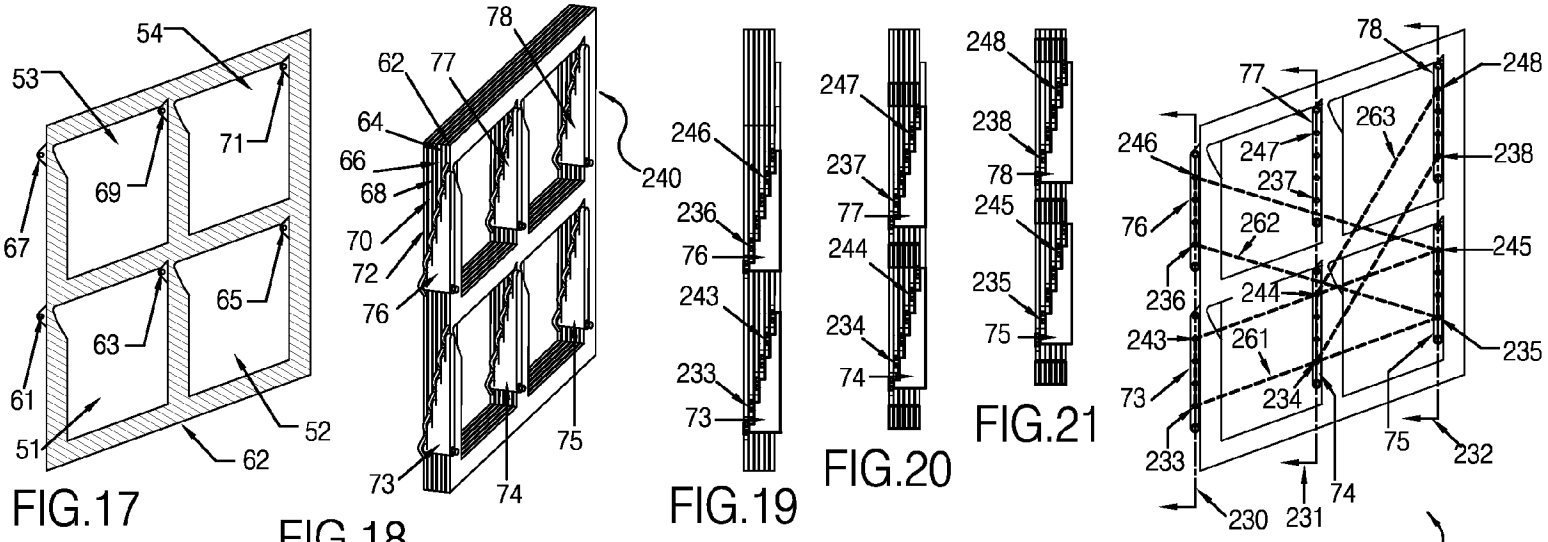
FIG.17
FIG.18
FIG.19
FIG.20
FIG.21
FIG.22
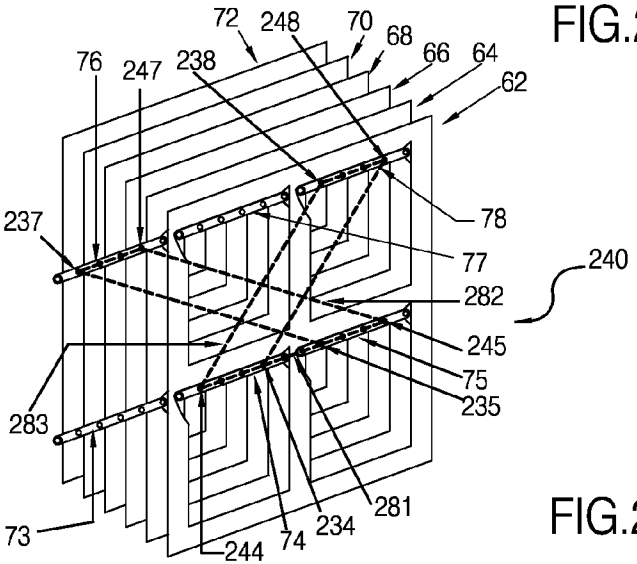
FIG.24
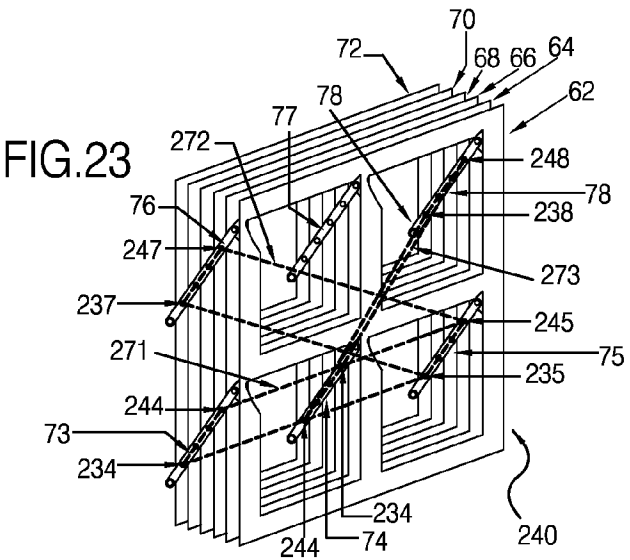
FIG.23

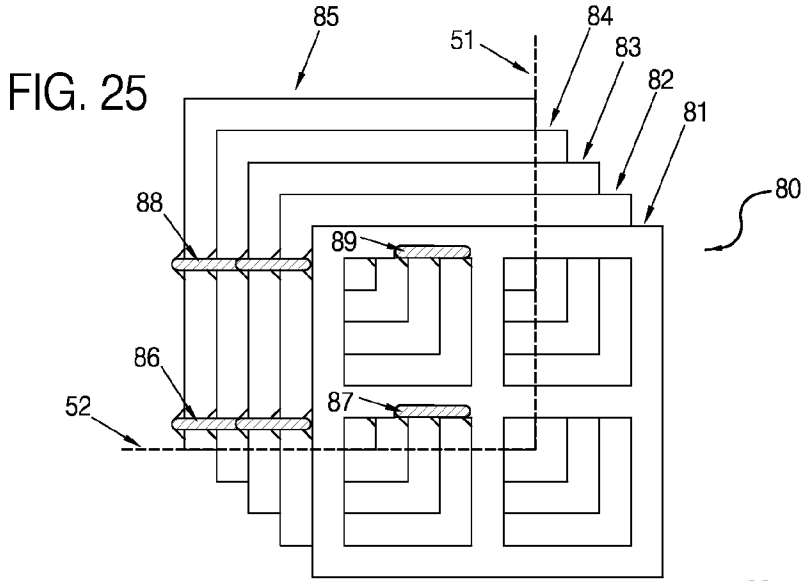
FIG. 25
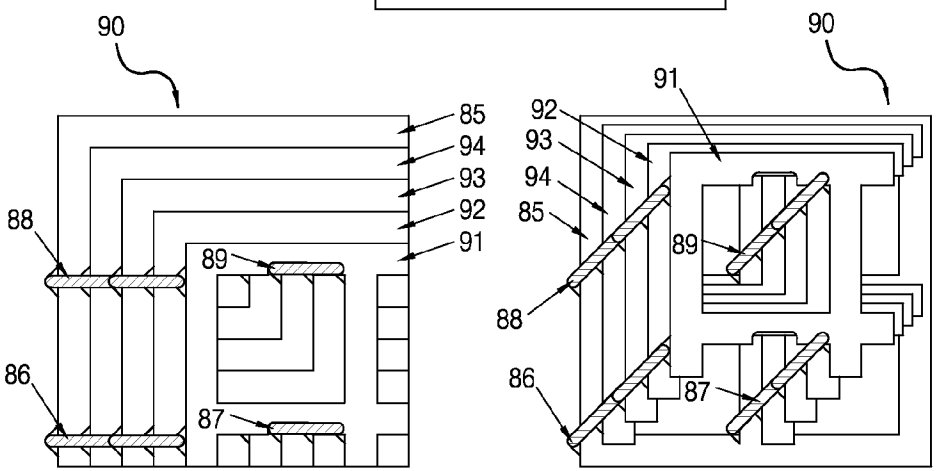
FIG.27
FIG.26
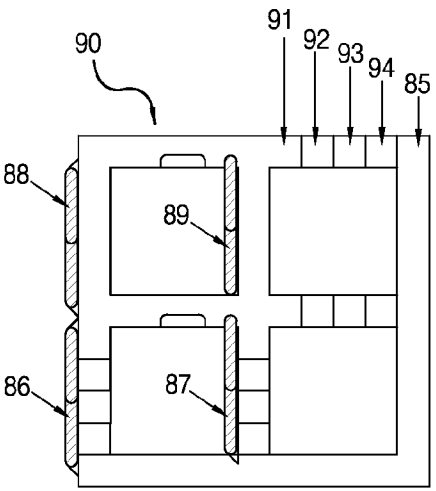
FIG.28

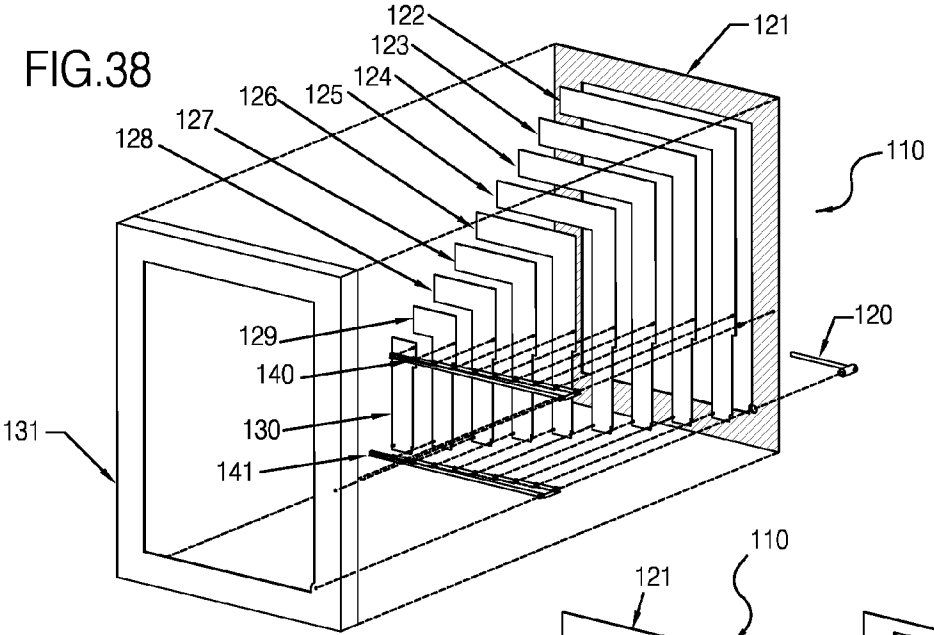
FIG.38
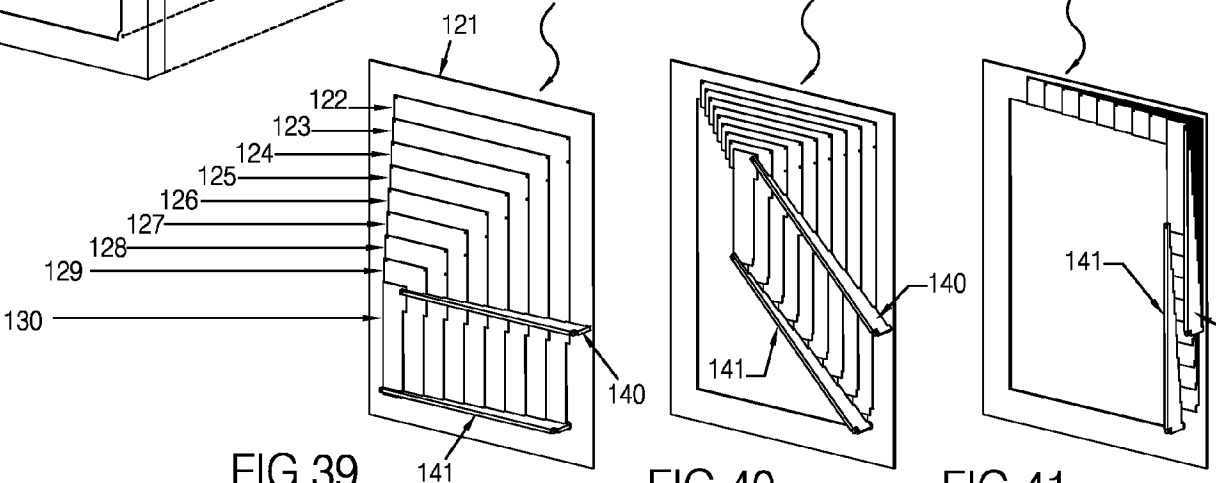
FIG.39
FIG.40
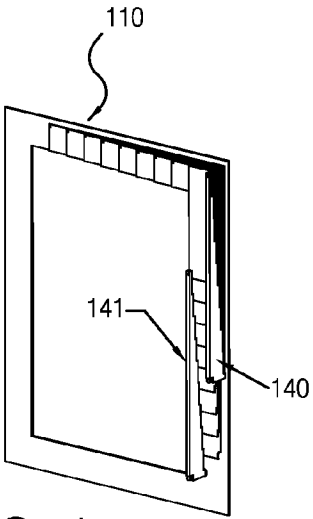
FIG.41

500
501
502
503
504
505
506
507
508
509
512
513
514
515
516
517
518
519
520
522
524
530

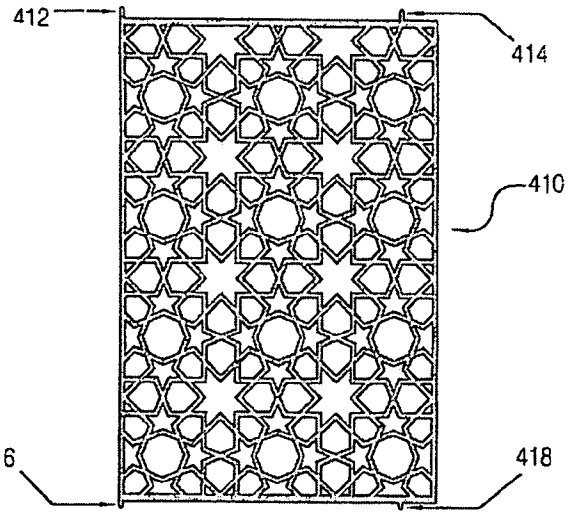
FIG.56
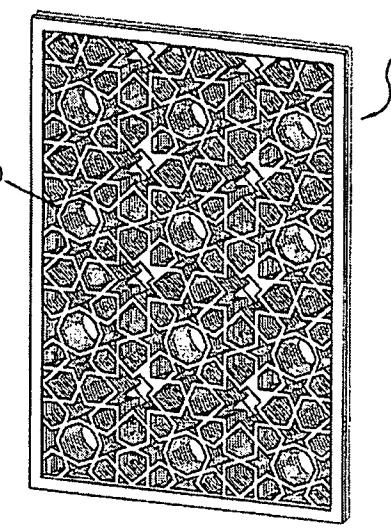
FIG.57
FIG.58
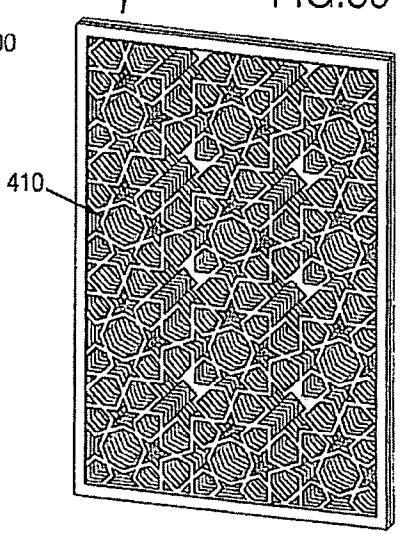
FIG.59

PANEL ASSEMBLIES FOR VARIABLE SHADING AND VENTILATION

This application claims priority of Ser. No. 60/789,248, filed Apr. 5, 2006.

BACKGROUND OF THE INVENTION

The façade plays a central role in determining a building's environmental performance, influencing how light, heat and air are exchanged with its surroundings. The environmental impact of a façade is based on two major factors; the first being basic material construction, and second the incorporation of operable elements such as windows, blinds, shades and shutters.

As part of a growing movement to develop sustainable buildings, a promising strategy is for buildings to actively adapt and respond to changing climatic conditions. In the context of the façade, this strategy may be implemented by motorizing operable façade elements, so that, for example, shades can extend and retract automatically. Sensors can take environmental data (i.e., temperature, light intensity and wind flow), and, utilizing computational intelligence, the building can optimize its environmental profile in a responsive manner.

This concept of a responsive façade has been termed "intelligent skin", indicating the analogy with natural systems.

The promise of this concept has, however, been limited by the particular openable devices that are currently available. The basic designs for windows, blinds, shades and shutters were set many years ago. While well-suited for manual control, these devices have significant limitations regarding their capacity for smooth, continuous and efficient motorized control.

In order to justify the investment in developing truly responsive façades, operable elements need to be considered as part of an integrated package with structural, glazing and mechanical systems. To successfully implement this strategy, such devices need to be adapted according to a building's specific design. Presently available shading and ventilation systems have significant limitations in their ability to be customized.

For example, it is a significant challenge to design blinds that fit non-orthogonal openings. A second challenge is when a shading system must adapt to a non-vertical orientation. Other limits are encountered when designing operable ventilation systems which are often based on rotating louvers.

The aim of the invention disclosed herein is to overcome these limitations in an economic and elegant way. It offers a new method to make operable façade devices which provide a surface of controlled permeability, smoothly varying between a covered state and a largely opened state.

Like blinds or shades, these devices are capable of controlling solar gain. Additionally, the present invention may be fabricated with sufficient strength to act in a structural capacity, thus providing the capability to control air flow in a similar manner as operable louvers.

Unlike louvers whose elements rotate to a position that is orthogonal to the surface of the façade, the elements in the disclosed invention move laterally. The invention may be thus termed "laminar cladding", indicating the organized layers of smooth laminar flow.

The benefits of this lateral control are two-fold: a) laminar devices are visually integrated with façade surface, rather than appearing as an appliqué, and b) it is possible to achieve greater transparency in the retracted position relative to a covered area compared to louvers.

Further advantages to the disclosed invention are the ability to cover any shape opening, to be installed in any orientation, and the ability to define unique design patterns for shading panels.

SUMMARY OF THE INVENTION

A variable panel assembly is herein disclosed which is comprised of a plurality of panels and a plurality of links, wherein by rotating one or more links, the assembly shifts between a largely uncovered configuration to a covered configuration, where, in the first configuration, the panel profiles are essentially aligned, and in the second configuration, the panel profiles are offset relative to one another. Further disclosed herein are methods to control the movement of the assembly, both manual and motorized.

The assembly is comprised of a plurality of panels, each panel having at least two pivot connections which are further comprised of at least two links, each link having a plurality of pivot connections that are arranged in stepwise fashion such that each pivot connection on each link is pivotally attached to a pivot connection on each panel. When rotating one or more links, the assembly shifts between a first position and said second position. For said first position, the profiles of the panels are all aligned such that a significant area of the assembly is uncovered. For the second position, the profiles of the panels are offset relative to each other such that a significant area of the assembly is covered relative to the first position.

Accordingly, it is an object of the invention to provide an improved panel assembly for both shading and ventilation.

Other objects of the invention will be apparent from the following description.

BRIEF DESCRIPTION OF THE DRAWINGS

FIG. 17 shows a panel 62 that has a parallelogram shape profile;

FIG. 18 shows a perspective view of assembly 240 which is parallelogram shaped, in an uncovered configuration;

FIGS. 19, 20 and 21 show sectional views of assembly 240;

FIGS. 22, 23 and 24 show plan views of assembly 240;

FIG. 25 shows a plan view of assembly 80 with planes 51 and 52 which indicate the profile of base panel 85;

FIG. 26 shows a plan view of assembly 90 which is based on assembly 80, but where all of the panels have been trimmed along planes 51 and 52;

FIGS. 27 and 28 show plan views of assembly 90 in partially uncovered and fully uncovered configurations respectively;

FIG. 38 shows an exploded view of assembly 110 with "L-shaped" panels;

FIGS. 39, 40 and 41 show perspective views of assembly 110 in covered, partially uncovered and fully uncovered configurations respectively;

FIG. 56 shows a plan view of panel 410 which has a perforation pattern based on traditional Islamic geometry; and FIGS. 57, 58 and 59 show perspective views of assembly 400, based on a traditional Islamic design, in uncovered, partially covered and fully covered configurations respectively.

DESCRIPTION OF THE DRAWINGS

Figure 1:
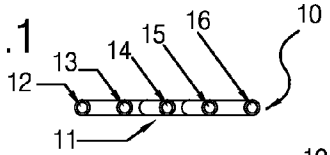
FIG. 1 shows a plan view of a link 10 with five pivots.
Figure 2:
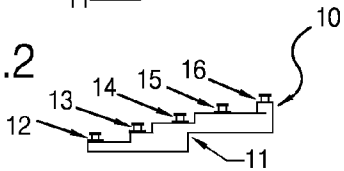
FIGS. 2 and 3 show elevation and perspective view respectively of link 10.
Figure 3:
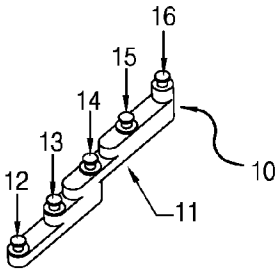

FIG. 1 shows a plan view of a link 10 that is comprised of a base piece 11 and five pivots 12, 13, 14, 15 and 16. FIG. 2 shows an elevation view of link 10 where it may be observed that pivots 12, 13, 14, 15 and 16 are arranged in stepwise fashion, each successive pivot lying on a level that is offset relative to its neighboring pivot. FIG. 3 shows a perspective view of link 10.

Figure 4:
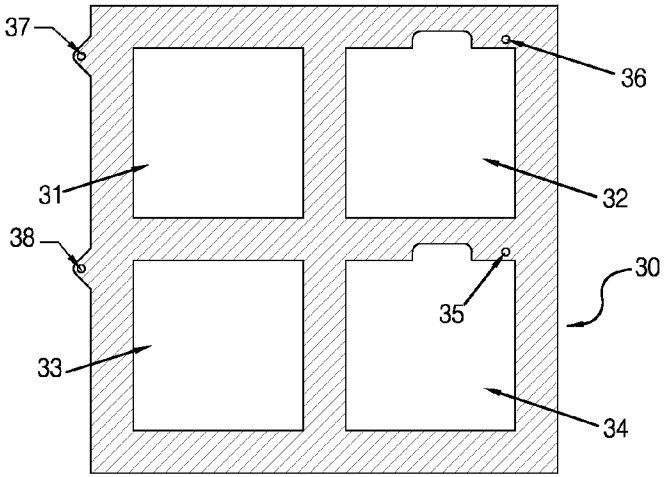
FIG. 4 shows a panel 30 with four openings and four pivot holes.

FIG. 4 shows a plan view of a panel 30 having four openings or perforations 31, 32, 33 and 34. Additionally, panel 30 has four pivot holes 35, 36, 37 and 38.

Figure 5:
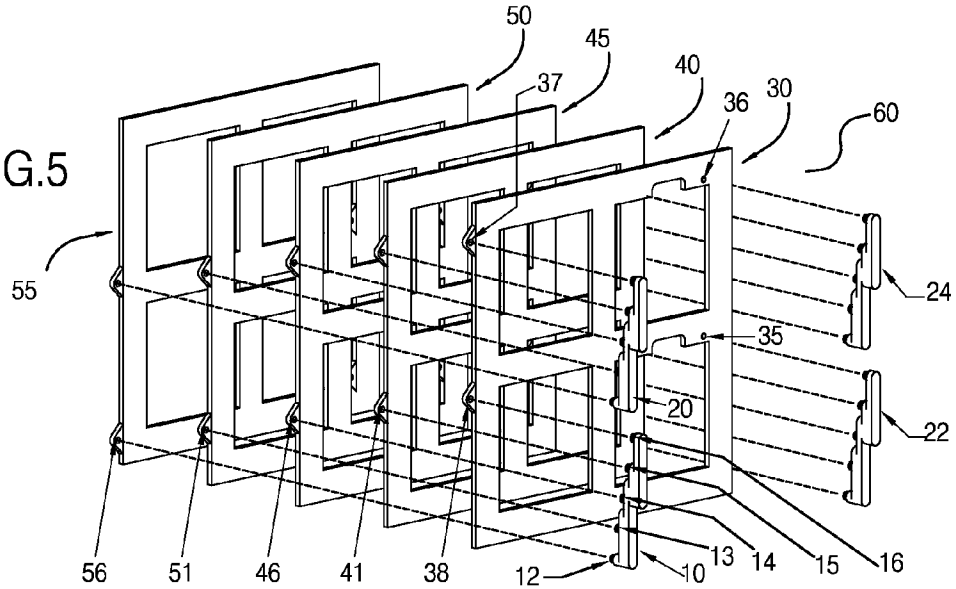
FIG. 5 shows an exploded view of assembly 60 which is comprised of four links and five panels.

FIG. 5 shows an exploded view of panel assembly 60, which is comprised of four links 10, 20, 22 and 24 and five panels 3, 40, 45, 50 and 55, each of which has four openings and four pivots. Pivot 16 belonging to link 10 is aligned such that it may be connected to hole 38 belonging to panel 30. Likewise, pivots 15, 14, 13 and 12 are aligned relative to holes 41, 46, 51, 56 respectively.

Links 20, 22 and 24 each have five pivots and are positioned relative to panels 30, 40, 45, 50 and 55, each of which has four holes, such that pivots and holes are aligned in similar fashion to link 10.

Figure 6:
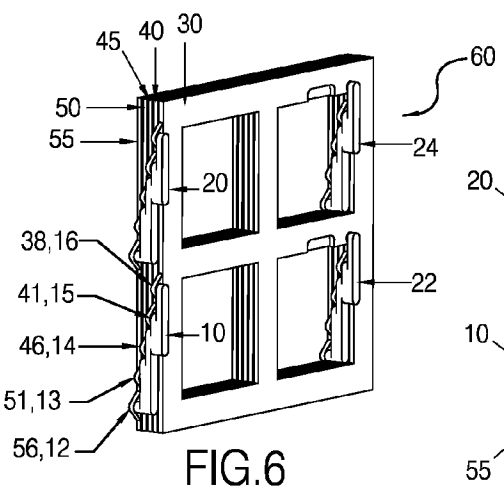
FIG. 6 shows a perspective view of assembly 60 in an uncovered configuration.

FIG. 6 shows a perspective view of panel assembly 60 wherein pivots 12, 13, 14, 15 and 16 have been connected to holes 56, 51, 46, 41 and 38 respectively. Likewise the five pivots each of links 20, 22 and 24 have been connected to their aligned holes in panels 30, 40, 45, 50 and 55. It may be seen that the five panels arranged in a stack such that their profiles are aligned, and openings 31, 32, 33 and 34 are unobstructed.

Figure 7:
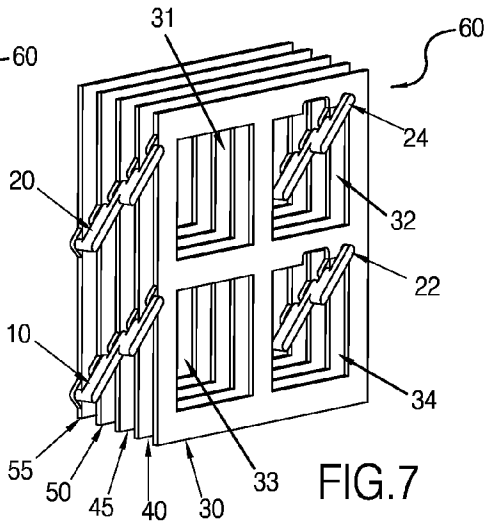

FIG. 7 shows panel assembly 60 where links 10, 20, 22 and 24 have been rotated relative to the panels thereby creating offsets between them. This displacement causes openings 31, 32, 33 and 34 to be partially covered.

Figure 8:
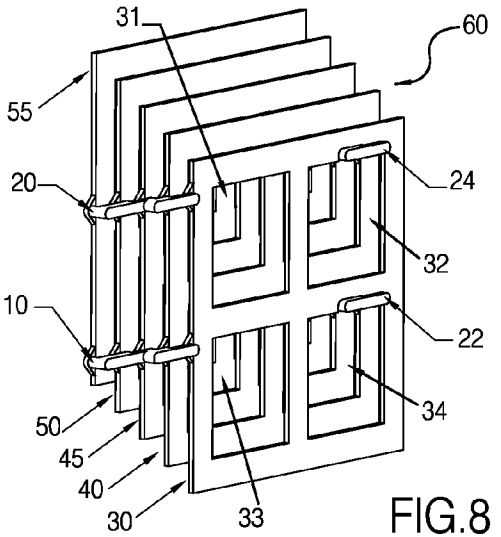
FIGS. 7 and 8 show perspective views of assembly 60 in partially uncovered and fully uncovered configurations respectively.

FIG. 8 shows assembly 60 where links 10, 20, 22 and 24 have been further rotated such that openings 31, 32, 33 and 34 are fully covered.

Figure 11:
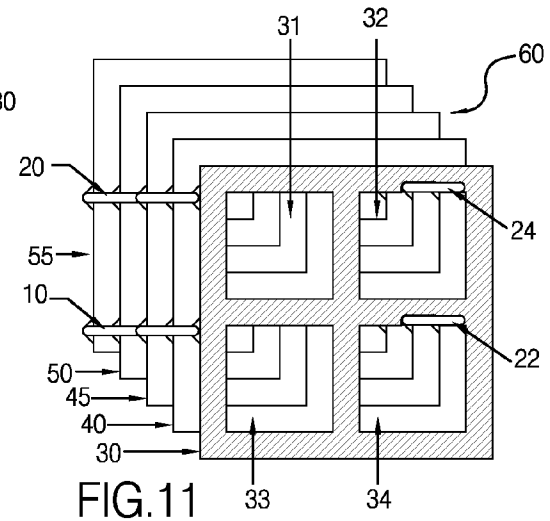
FIGS. 9, 10, and 11 show plan views of assembly 60 in covered, partially covered and fully uncovered configurations respectively.
Figure 10:
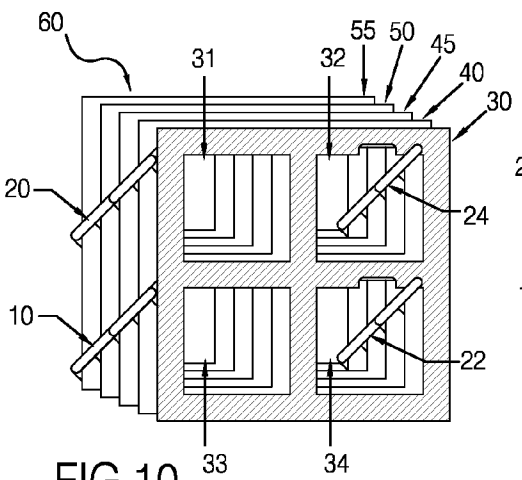
Figure 9:
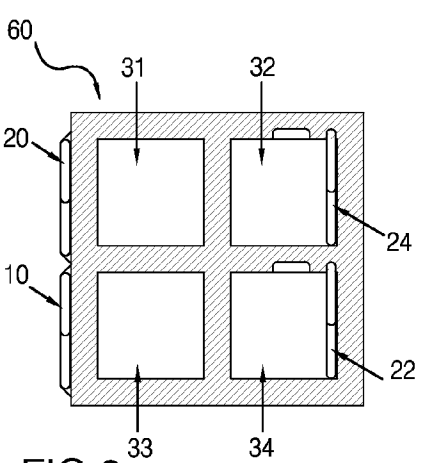

FIG. 9 shows a plan view of assembly 60 in a configuration where openings 31, 32, 33 and 34 are unobstructed. FIG. 10 shows a plan view of assembly 60 where links 10, 20, 22 and 24 have been rotated, thus partially covering openings 31, 32, 33 and 34. FIG. 11 shows assembly 60 where links 10, 20, 22 and 24 have been fully rotated, thereby fully covering openings 31, 32, 33 and 34.

Figure 14:
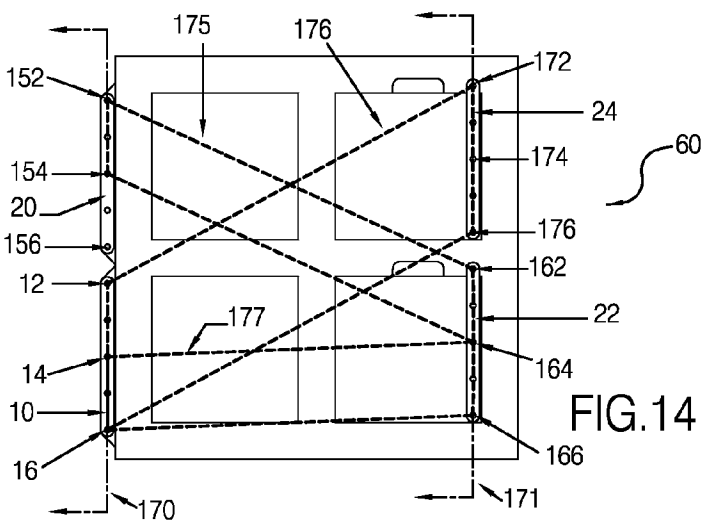
FIG. 14 shows a plan view of assembly 60 with shapes 175, 176 and 177 shown revealing underlying geometric properties.
Figure 12:
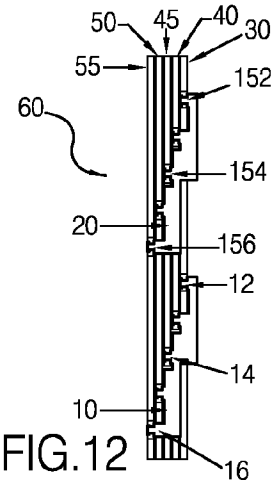

FIG. 12 shows a sectional view of assembly 60, the particular section being indicated by line 170 shown in FIG. 14. Links 10 and 20 are shown as well as panels 30, 40, 45, 50 and 55. Pivot 16 belonging to link 10 lies on the same level as pivot 156 belonging to link 20. Similarly, pivot 14 lies on the same level as pivot 154; pivot 12 lies on the same level as pivot 152.

Figure 13:
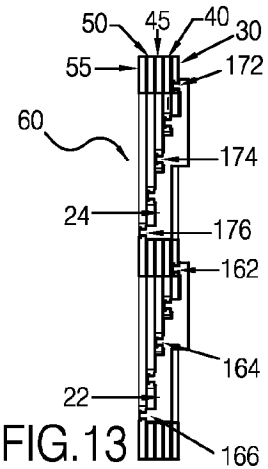
FIGS. 12 and 13 show sectional views of assembly 60.

FIG. 13 shows a sectional view of assembly 60 where the section is indicated by line 171 shown in FIG. 14. Pivot 166 belonging to link 22 lies on the same level as pivot 176 belonging to link 24. Similarly, pivot 164 lies on the same level as pivot 174; pivot 162 lies on the same level as pivot 172.

Further, pivots 16, 156, 166 and 176 all share a common level. Similarly, pivots 14, 154, 164 and 174 all share a common level. Similarly, pivots 12, 152, 162 and 172 all share a common level.

FIG. 14 shows a plan view of panel assembly 60. Shape 175, formed by connecting pivots 154, 164, 162 and 152, is a parallelogram. Similarly shape 176, formed by connecting pivots 16, 176, 172 and 12, is a parallelogram. Similarly shape 177, formed by connecting pivots 16, 166, 164 and 14, is a parallelogram. Note that the sides of shapes 175, 176 and 177 that connect pivots belonging to different links, those connections are between pivots that share a common level.

Figure 15:
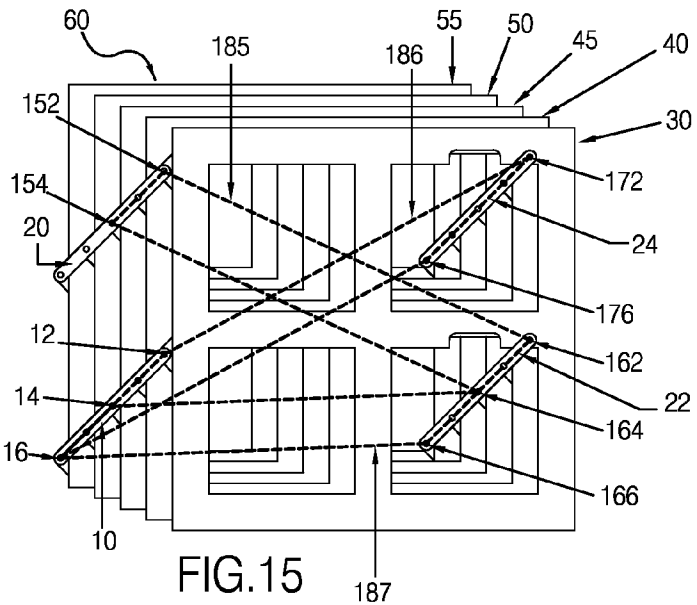

FIG. 15 shows a plan view of assembly 60 in a second position. Shape 185 is formed similarly to shape 175, that is by connecting pivots 154, 164, 162 and 152. Shape 185 is a parallelogram. Shape 186 is formed similarly to shape 176 and is also a parallelogram. Shape 187 is formed similarly to shape 177 and is also a parallelogram.

Figure 16:
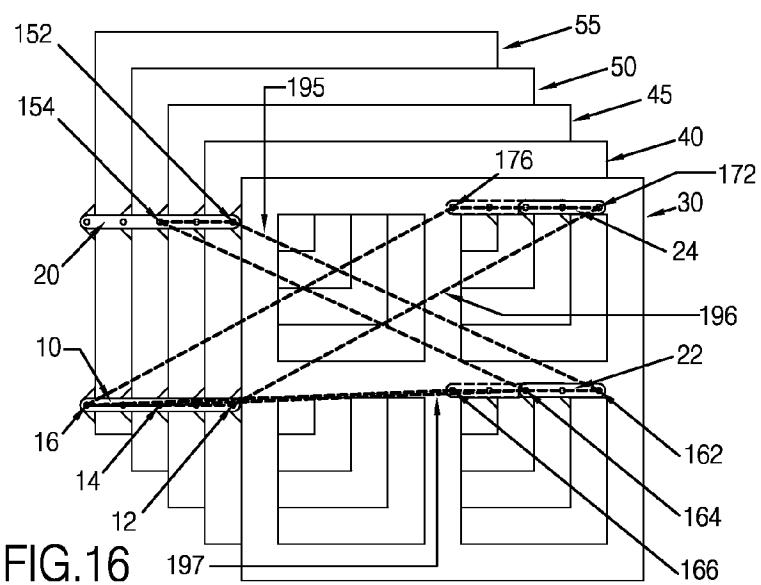
FIGS. 15 and 16 show plan views of assembly 60 in partially uncovered and fully uncovered configurations along with shapes that reveal underlying geometry.

FIG. 16 shows a plan view of assembly 60 in a third position. Shape 195 is formed similarly to shapes 175 and 185 and is a parallelogram. Shape 196 is formed similarly to shapes 176 and 186 and is also a parallelogram. Shape 197 is formed similarly to shapes 177 and 187 and is also a parallelogram.

FIG. 17 shows a plan view of panel 62 whose perimeter is parallelogram-shaped. Panel 62 has four openings 51, 52, 53 and 54 and also has six pivots 61, 63, 65, 67, 69 and 71.

FIG. 18 shows a perspective view of assembly 240 which is comprised of six panels 62, 64, 66, 68, 70 and 72 and six links 73, 74, 75, 76, 77 and 78. It may be seen that the six parallelogram-shaped panels are all aligned with one another so that the openings are unobstructed.

FIGS. 19, 20 and 21 show sectional views of assembly 240. The section shown in FIG. 19 is indicated by line 230 shown in FIG. 22. The section shown in FIG. 20 is indicated by line 231 shown in FIG. 22. The section shown in FIG. 21 is indicated by line 232 shown in FIG. 22.

Pivots 233, 236, 234, 237, 235 and 238 all share a common level. Similarly, pivots 243, 246, 244, 247, 245 and 248 all share a common level.

FIG. 22 shows a plan view of panel assembly 240. Shape 261, formed by connecting pivots 234, 235, 245 and 243, is a parallelogram. Similarly shape 262, formed by connecting pivots 236, 235, 245 and 246, is a parallelogram. Similarly shape 263, formed by connecting pivots 234, 238, 248 and 244, is a parallelogram. Note that the sides of shapes 261, 262 and 263 that connect pivots belonging to different links, those connections are between pivots that share a common level.

FIG. 23 shows a plan view of assembly 240 in a second position. Shape 271 is formed similarly to shape 261, that is by connecting pivots 234, 235, 245 and 243. Shape 261 is a parallelogram. Shape 272 is formed similarly to shape 262 and is also a parallelogram. Shape 273 is formed similarly to shape 263 and is also a parallelogram.

FIG. 24 shows a plan view of assembly 240 in a third position. Shape 281 is formed similarly to shapes 271 and 261 and is a parallelogram. Shape 282 is formed similarly to shapes 272 and 262 and is also a parallelogram. Shape 283 is formed similarly to shapes 273 and 263 and is also a parallelogram.

FIG. 25 shows a plan view of assembly 80 which is comprised of five panels 81, 82, 83, 84 and 85 as well as four links 86, 87, 88 and 89. Also shown in FIG. 25 are two planes 51 and 52 which lie along the edges of panel 85.

FIG. 26 shows an assembly 90 which is similar to assembly 80 except that the panels 81, 82, 83 and 84 have been trimmed along lines 51 and 52 to provide four reconfigured panels 91, 92, 93 and 94. In this way, the entire assembly lies within the profiles defined by panel 85.

FIGS. 27 and 28 show assembly 90 where links 86, 87 88 and 89 have been successively rotated such that a partially opened configuration, then fully opened configuration are provided. In each position, the entire assembly lies within the profile defined by panel 85.

Figure 29:
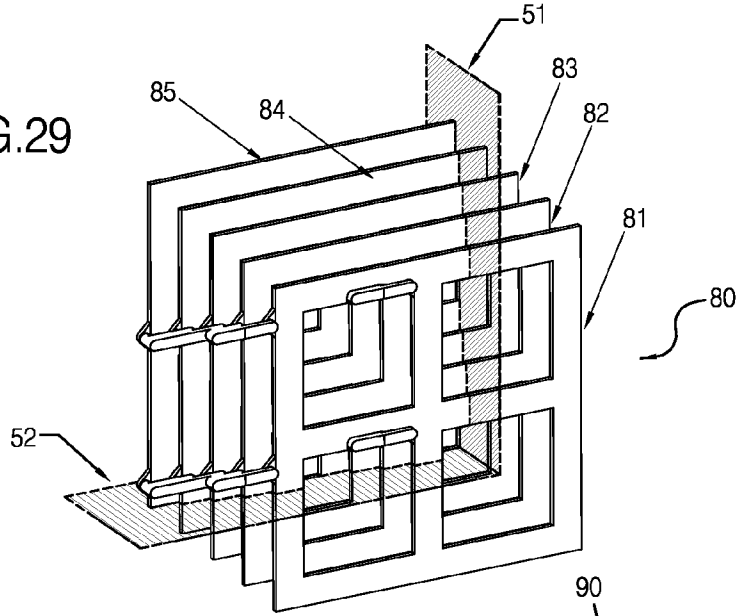
FIG. 29 shows a perspective view of assembly 90 with cutting planes 51 and 52.

FIG. 29 shows a perspective view of assembly 80 which is comprised of five panels 81, 82, 83, 84 and 85 as well as four links 86, 87, 88 and 89. Also shown in FIG. 29 are two planes 51 and 52 which lie along the edges of panel 85.

Figure 30:
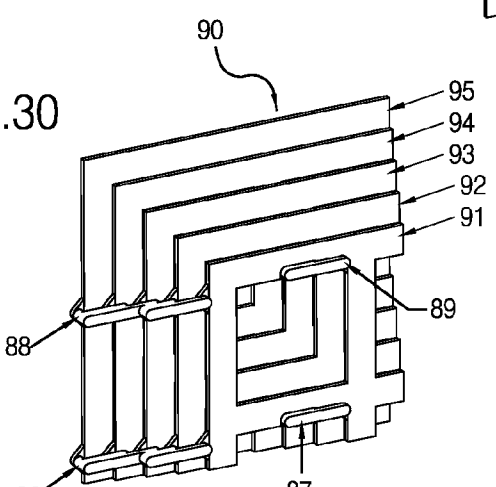

FIG. 30 shows a perspective view assembly 90 which is identical to assembly 80 except that the panels 81, 82, 83 and 84 have been trimmed along planes 51 and 52 to provide four reconfigured panels 91, 92, 93 and 94. In this way, the entire assembly lies within the profile defined by panel 85.

Figure 31:
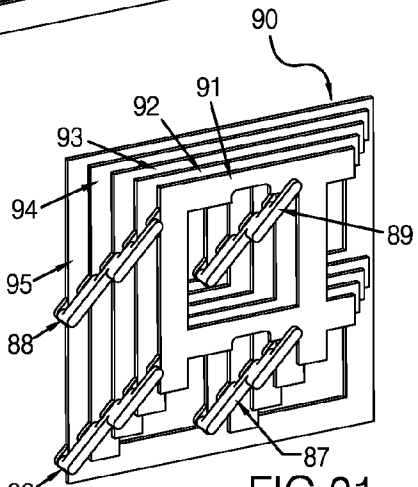
FIGS. 30, 31 and 32 show perspective views of assembly 90 in covered, partially uncovered and fully uncovered configurations respectively.
Figure 32:
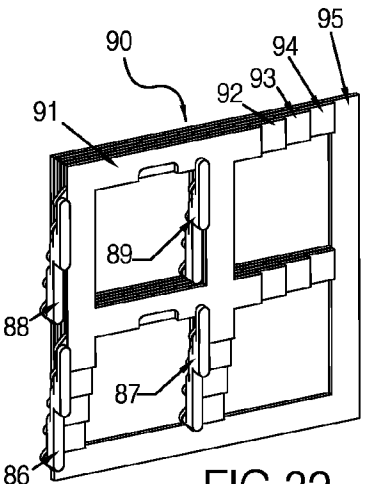

FIGS. 31 and 32 show assembly 90 where links 86, 87 88 and 89 have been successively rotated such that a partially opened configuration, then fully opened configuration are provided. In each position the entire assembly lies within the profile defined by panel 85.

Figure 33:
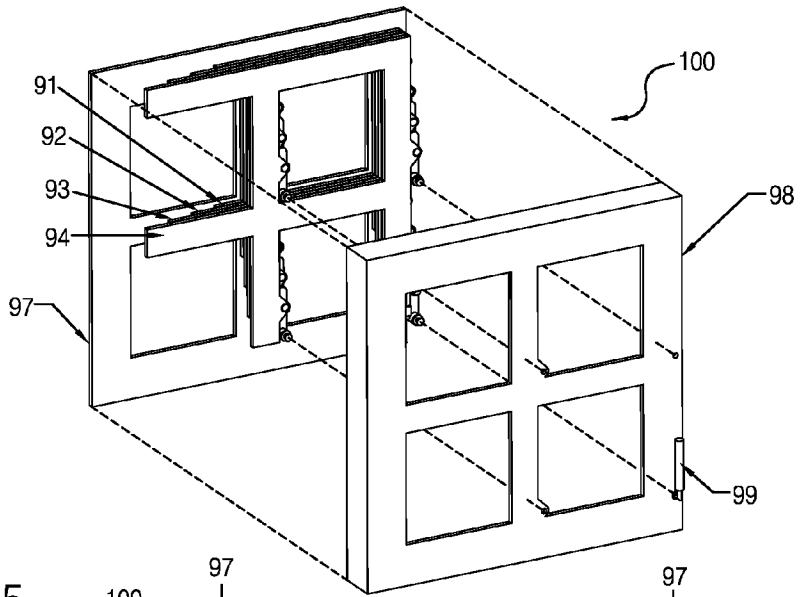
FIG. 33 shows an exploded view of assembly 100 with enclosing elements 97 and 98 as well as drive handle 99.

FIG. 33 shows an exploded view of assembly 100 which is comprised of four moving panels 91, 92, 93 and 94 which were previously shown as part of assembly 90, as well as a stationary panel 97, and a covering piece 98. Also shown is a drive handle 99.

Figure 34:
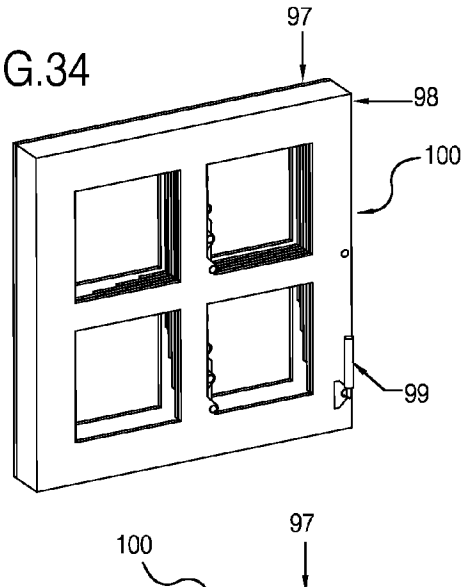
FIGS. 34, 35 and 36 show perspective views of assembly 100 in uncovered, partially covered and fully covered configurations respectively.

FIG. 34 shows assembly 100 wherein panels 91, 92, 93 and 94 have are housed within an enclosure formed by stationary panel 97 and piece 98. The four openings of assembly 100 are unobstructed.

Figure 36:
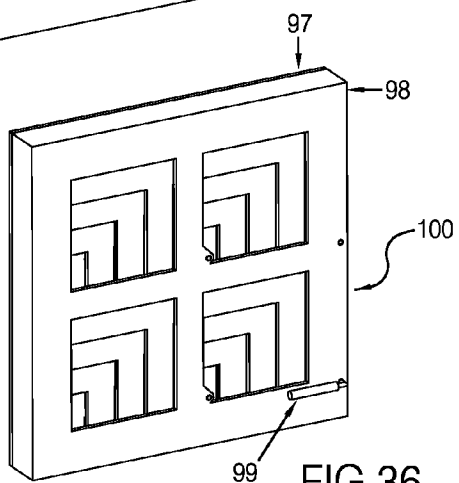
Figure 35:
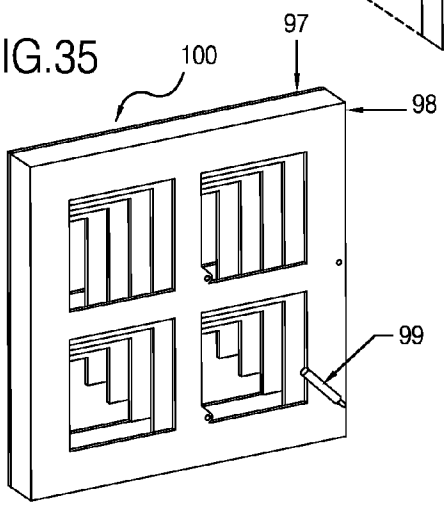

FIGS. 35 and 36 show assembly 100 in a partially opened configuration, then fully opened configuration respectively. By rotating handle 99 the assembly is driven to each successive configuration. In each position panels 91, 92, 93 and 94 have are housed within the enclosure formed by panel 97 and piece 98.

Figure 37:
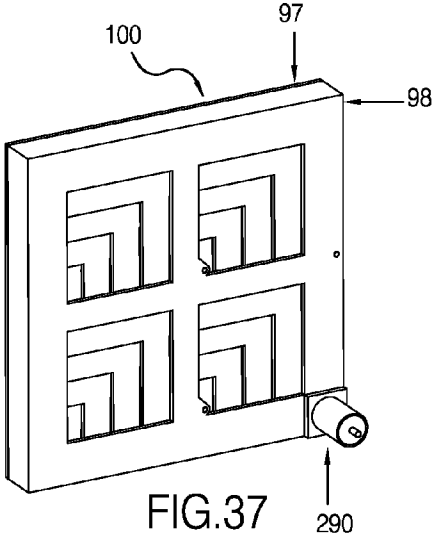
FIG. 37 shows an alternate configuration of assembly 100 with a motor.

FIG. 37 shows a perspective view of assembly 100 where drive handle 99 has been replaced by motor 290. This indicates a preferred configuration of the invention when it is part of an automated system.

FIG. 38 shows an exploded view of an alternate embodiment of the invention, assembly 110 which is comprised of a stationary panel 121, and covering piece 131 as well as two links 140 and 141. Assembly 110 is further comprised of nine moving panels 122, 123 124, 125, 126 127, 128 129 and 130 each of which has an "L-shaped" profile.

FIG. 39 shows assembly 110 wherein each moving panel is attached to link 140 by one pivot connection. In addition each moving panel is attached link to 141 by a second pivot connection. Further, link 140 is attached to stationary panel 121 by a pivot connection. Likewise link 141 is attached to stationary panel 121 by a pivot connection.

FIG. 40 shows assembly 110 wherein links 140 and 141 have been rotated to a second position thereby partially clearing the opening in link 110. FIG. 41 shows assembly 110 wherein links 140 and 141 have been rotated to a third position thereby fully clearing the opening in assembly 110.

Figures 42, 43, 44, 45:
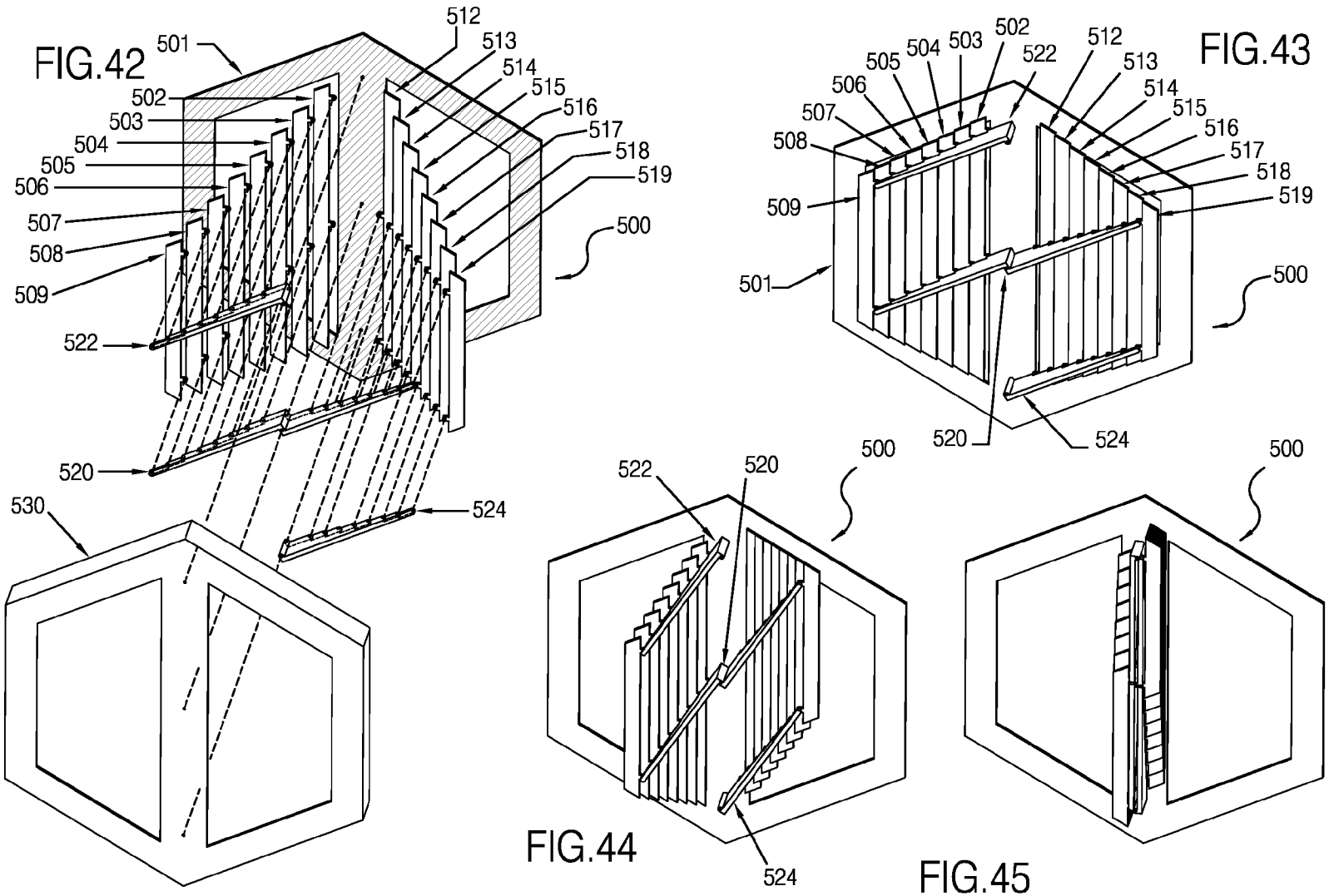
FIG. 42 is an exploded view of assembly 500.
FIGS. 43, 44 and 45 show perspective views of assembly 500.

FIG. 42 shows an exploded view of an alternate embodiment of the invention, assembly 500 which is comprised of a stationary panel 501, and covering piece 530 as well as three links 520, 522 and 524. Assembly 500 is further comprised of sixteen moving panels 502, 503, 504, 505, 506, 507, 508, 509, 512, 513, 514, 515, 516, 517, 518 and 519 each of which has an elongated profiles.

FIG. 43 shows assembly 500 wherein each moving panel is attached to link 520 by one pivot connection. In addition, moving panels 503, 503, 504, 505, 506, 507, 508 and 509 are each attached link to 522 by a second pivot connection. Further, moving panels 512, 513, 514, 515, 516, 517, 518 and 519 are each attached link to 524 by a second pivot connection. Links 520, 522 and 524 are each attached to stationary panel 501 by pivot connections.

FIG. 44 shows assembly 500 wherein links 520, 522 and 524 have been rotated to a second position thereby partially clearing openings in link 501. FIG. 45 shows assembly 500 wherein links 520, 522 and 524 have been rotated to a third position thereby fully clearing the opening in assembly 500.

Figure 46:
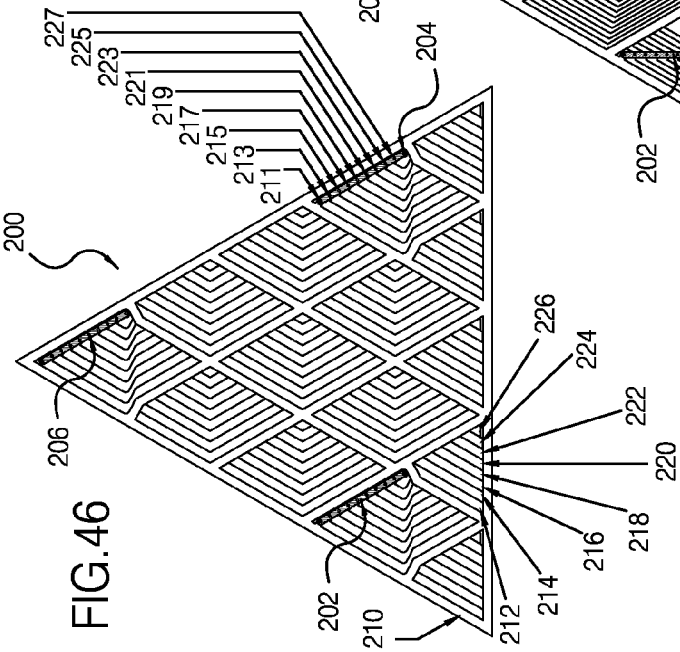

FIG. 46 shows a plan view of an alternate embodiment of the invention, panel assembly 200 which has a triangular profile and is shown in a fully covered configuration. Assembly 200 is comprised of 9 panels 210, 212, 214, 216, 218, 220, 222, 224 and 226, as well as three links 202, 204 and 206. Panel 210 is attached to link 204 by pivot 211. Panels 212 through 226 are each pivotally attached to link 201 by pivots 213 through 227 respectively. Similarly, panels 212 through 226 are pivotally attached to links 202 and 206 in successive fashion.

Figure 48:
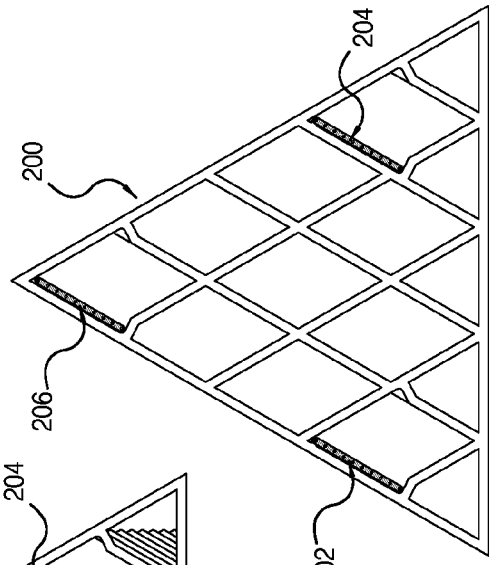
FIGS. 46, 47 and 48 show plan views of triangular shaped assembly 200 in covered, partially uncovered and fully uncovered configurations respectively.
Figure 47:
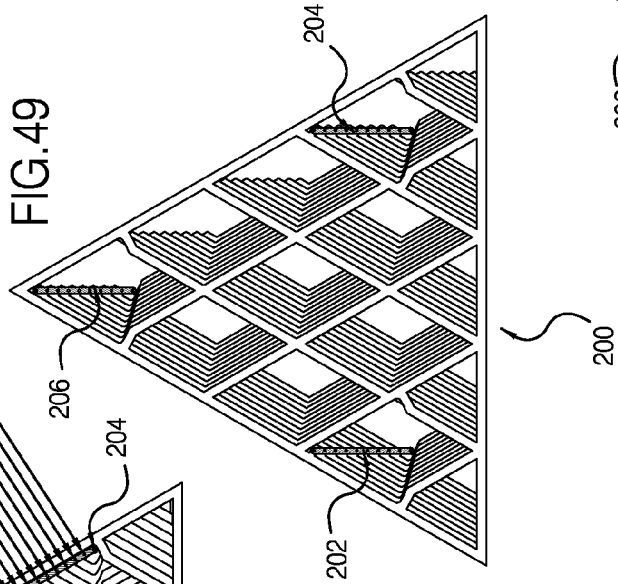

FIG. 47 shows assembly 200 in a partially opened configuration wherein links 202, 204 and 206 have been partially rotated. FIG. 48 shows assembly 200 in an opened configuration wherein links 202, 204 and 206 have been completely rotated.

Figure 51:
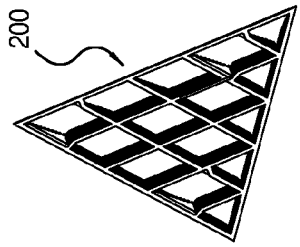
FIGS. 49, 50 and 51 show perspective views of triangular shaped assembly 200 in covered, partially uncovered and fully uncovered configurations respectively.
Figure 50:
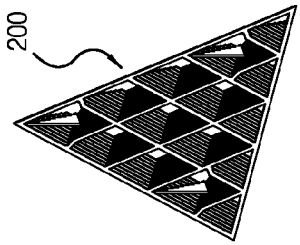
Figure 49:
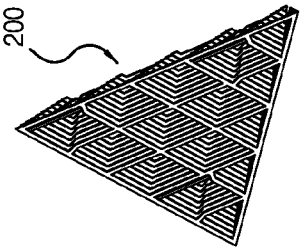

FIG. 49 shows a perspective view of assembly 200 in covered configuration. FIGS. 50 and 51 show perspective views of assembly 200 in partially covered and opened configurations respectively. Assembly 200 indicates that the invention may be embodied utilizing virtually any perimeter shape that is desired.

Figure 52:
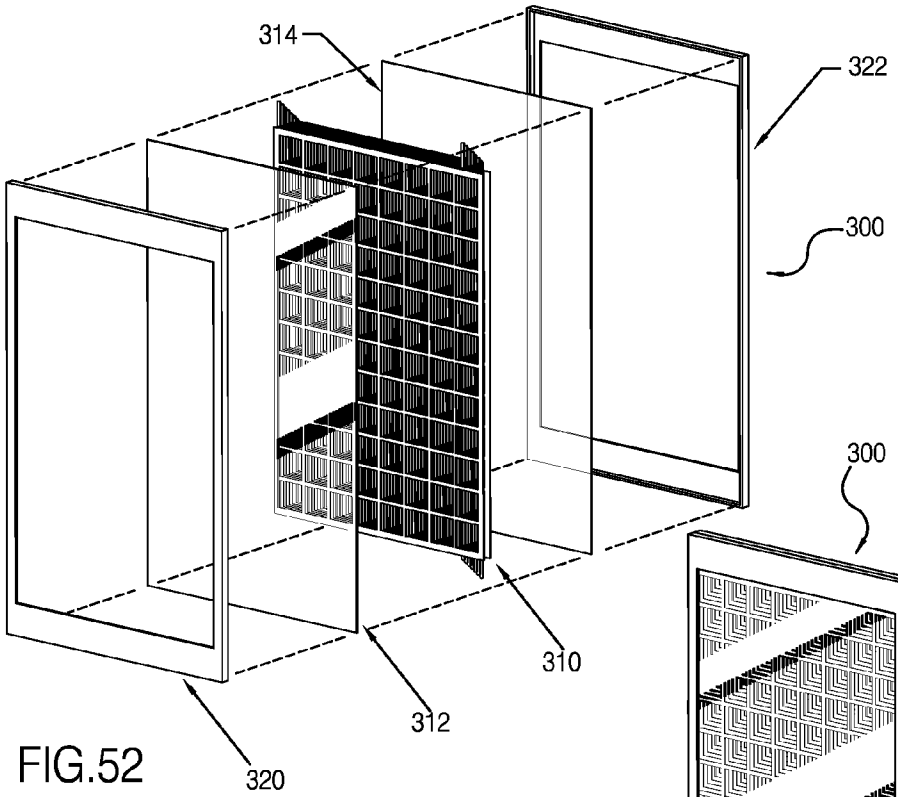
FIG. 52 shows an exploded view of assembly 300 with enclosing glass pieces.

FIG. 52 shows an exploded view of a unit 300 which is comprised of a panel assembly 310, two glass pieces 312 and 314, as well as two frame pieces 320 and 322.

Figure 53:
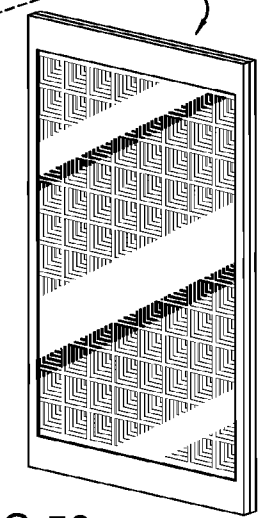
FIGS. 53, 54 and 55 show perspective views of assembly 30, which is enclosed between glass pieces, in covered, partially uncovered and fully uncovered configurations respectively.

FIG. 53 shows a perspective view of unit 300 in a fully covered configuration. Panel assembly 310 is thus encased within the double glazing of glass pieces 312 and 314.

Figure 54:
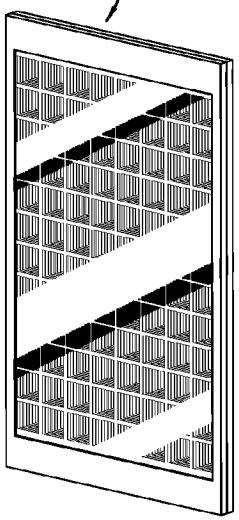
Figure 55:
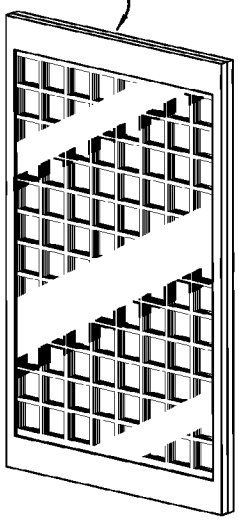

FIGS. 54 and 55 shows perspective views of unit 300 wherein panel assembly 310 is shown in partially opened and fully opened configurations respectively.

FIG. 56 shows a plan view of panel 410 which is comprised of a sheet that has numerous perforations that form a traditional Islamic geometric pattern. Panel 410 is further comprised of four pivots 412, 414, 416 and 418.

FIG. 57 shows a perspective view of panel assembly 400 which is comprised of a series of panels similarly patterned as panel 410. Assembly 400 is shown in a fully opened configuration where each stacked panel is aligned with each other.

FIGS. 58 and 59 show perspective views of assembly 400 in partially opened and fully opened configurations respectively. Assembly 400 indicates that the invention may be embodied utilizing virtually any desired design for the panel pattern.

The scope of the invention is in the following claims:

1. A panel assembly comprising:

at least two panels disposed substantially one on top of the other, each said panel having at least two pivot connections;

at least two link elements, each link element having at least two pivots which are arranged in a step wise fashion;

wherein one of said pivots of each of said link elements is pivotally attached to one of said pivot connections on one of said panels;

wherein a second of said pivots of each of said link elements is pivotally attached to one of said pivot connections on a second of said panels;

wherein said panels are moveable relative to one another between a first position and a second position in response to rotation of at least one of said link elements such that said panels are substantially aligned in said first position and are offset with one another in said second position; wherein each said panel has at least one opening such that, in said first position, said openings of said panels are substantially aligned for defining a passage and, in said second position, said openings of said panels are not substantially aligned, thereby covering at least a portion of said passage; and wherein a first pivot of one of said link elements, a second pivot of said one of said link elements, a first pivot of another of said link elements and a second pivot of said another of said link elements together define a shape in the form of a parallelogram.

2. The panel assembly of claim 1, wherein said shape remains a parallelogram when said panels are moved between said first and second positions.

3. The panel assembly of claim 1, wherein one of said at least two panels comprise a base panel having a profile and wherein the remaining panel or panels always lies within the profile of said base panel when said panels are moved between said first and second positions.

4. The assembly of claim 1, further including a drive handle connected to at least one of said panels for operatively moving said panels between said first and second positions.

5. The assembly of claim 1, further including a motor operatively connected to at least one of said panels for driving said panels between said first and second positions.

6. The assembly of claim 1, wherein each said panel has a rectangular shaped profile.

7. The assembly of claim 1, wherein each said panel has an L-shaped profile.

8. The assembly of claim 1, wherein each said panel has an elongated profile.

9. The assembly of claim 6, wherein each said panel has four openings such that, in said first position, corresponding openings in each said panel are aligned for defining four passages, and, in said second position, said corresponding openings are not aligned, thereby covering at least a portion of each said passage.

10. The assembly of claim 1, wherein the number of panels correspond to the number of pivots of each link element.

11. The assembly of claim 1, wherein the number of link elements correspond to the number of pivot connections of each said panel.

12. The panel assembly of claim 11, wherein said shape is always a parallelogram when said panels move between said first and second positions.

13. The panel assembly of claim 12, wherein each said panel has at least one opening such that, in said first position, said openings of said panels are substantially aligned for defining a passage and, in said second position, said openings of said panels are not substantially aligned, thereby covering at least a portion of said passage.

14. The assembly of claim 1 wherein said first panel is disposed in a first plane and said second panel is disposed in a second plane, said planes being parallel to each other and said panels remaining within the respective planes as they move between said positions.

15. The assembly of claim 1 wherein each said panel has an angular orientation that does not change as said panels move between said positions.

* * * * *